United States Patent [19]

Schmerzler

[11] 4,398,396

[45] Aug. 16, 1983

[54] MOTOR-DRIVEN, EXPANDER-COMPRESSOR TRANSDUCER

[76] Inventor: Lawrence J. Schmerzler, 539 Laurel Pl., South Orange, N.J. 07097

[21] Appl. No.: 161,769

[22] Filed: Jun. 23, 1980

Related U.S. Application Data

[63] Continuation-in-part of Ser. No. 914,882, Jun. 12, 1978, Pat. No. 4,208,855, which is a continuation-in-part of Ser. No. 417,958, Nov. 21, 1973, Pat. No. 4,094,169, which is a continuation of Ser. No. 59,306, Jul. 29, 1970, abandoned.

[51] Int. Cl.[3] ..... F25B 1/02; F04B 35/00

[52] U.S. Cl. ..... 62/116; 62/403; 417/392

[58] Field of Search ..... 62/403, 116; 417/392

[56] References Cited

U.S. PATENT DOCUMENTS

| | | | |
|---|---|---|---|
| 3,277,658 | 10/1966 | Leonard, Jr. | 62/116 |
| 4,094,169 | 6/1978 | Schmerzler | 62/498 |
| 4,208,885 | 6/1980 | Schmerzler | 62/403 |
| 4,235,079 | 11/1980 | Masser | 62/116 |

*Primary Examiner*—William L. Freeh

*Attorney, Agent, or Firm*—Siegmar Silber

[57] ABSTRACT

The expander-compressor transducer of this invention is for expanding refrigerant fluid from a high pressure source into a low pressure heat absorber while simultaneously precompressing the same fluid stream derived from the low pressure heat absorber.

The device includes a body enclosing a chamber for confinement of refrigerant fluid; motor driven, a fluid-responsive piston arranged to oscillate in the chamber and dividing the chamber into an expansion chamber at one end and a compression chamber at the other end, a motor drive for oscillating the piston; a fluid control regulator for permitting flow of fluid into and out of the expansion chamber and into the compression chamber; and a check valve for permitting the refrigerant to flow out of the compression chamber whenever the pressure in the compression chamber overcomes the check valve.

The device effectively provides oscillatory movement of the fluid responsive piston within the chamber, causing concurrently the refrigerant fluid stream to expand in the expansion chamber and to compress in the compression chamber, and producing a cooling effect.

7 Claims, 10 Drawing Figures

MOTOR-DRIVEN, EXPANDER-COMPRESSOR TRANSDUCER

BACKGROUND OF THE INVENTION

This invention is filed as a continuation-in-part of copending patent application, Ser. No. 914,882, filed June 12, 1978 now U.S. Pat. No. 4,208,855 issued June 24, 1980; which in turn was a continuation-in-part of copending application, Ser. No. 417,958, filed Nov. 21, 1973, now U.S. Pat. No. 4,094,169 issued June 13, 1978; and which in turn was a continuing patent application of copending patent application, Ser. No. 59,306 filed July 29, 1970, now abandoned.

FIELD OF THE INVENTION

This invention refers generally to an improvement in open-cycle refrigeration processes and more particularly to a higher efficiency refrigeration process which is enhanced by the inclusion therein of an expander-compressor transducer. In addition to refrigeration, the process is applicable to air conditioning, cryogenic equipment, and heat pumping systems.

DESCRIPTION OF PRIOR ART

In the past, the basic components of the well-known refrigeration or vapor compression systems included a compressor, a condenser, a throttling expansion valve, an evaporator. The compressor is generally driven by some outside motive source such as an electric motor, engine, or turbine and compresses the cold-refrigerant vapor exiting from the evaporator to a high pressure and temperature. This vapor is generally superheated, high-temperature, high-pressure gas and flows into the condenser where such gas is condensed to a compressed liquid state. This liquid then passes through a throttling expansion valve from which the liquid passes from its inflowing high-pressure, compressed-liquid state to a cooled outflowing low pressure, as a very wet vapor, consisting of a mixture of liquid and vapor under saturated conditions of temperature and pressure. This process is variously known as throttling, is enthalpic or irreversible, free expansion, which is wasteful of energy and is characterized by a restriction between the condenser and the evaporator. The restriction is an orifice, a capillary tube, or a valve. The cooled, low-pressure wet mixture flows through the evaporator, where heat is absorbed from the surrounding environment, and in so doing, changes in state from an initially wet mixture to a saturated or slightly superheated vapor on exiting from the evaporator. The cooling effect is brought about by the change in state of the liquid particles to a vapor and is known as heat of vaporization. The cool, low-pressure vapor is drawn into the suction side of the compressor and repeats the cycle. Similar thermodynamic processes employing the above described vapor compression system are used in air conditioning, cryogenic equipment, heat pumps and refrigerators. The conventional systems are in wide use but have performance limitations primarily attributable to the described throttling process. Conventional vapor compression systems degrade rapidly in performance as the temperature differential increases between the low-temperature evaporator and the high-temperature condenser. This temperature differential is inherent in the particular application and reflects the spread between the ambient temperature and operational temperature required by the system. Frequently, as in the case of air conditioners and heat pumps, poor performance is experienced under high-ambient temperatures. In ultra-low-temperature systems, such as cryogenic equipment or low-temperature refrigerators, generally two or more stages of vapor compression refrigeration are utilized to obtain satisfactory operation over a broad temperature spread. In the above-described vapor compression cycle, increasing inefficiency is a concomitant of increasing temperature spread. Such a relationship between temperature spread and efficiency is thermodynamically demonstrable even for the most efficient refrigeration or heat pumps known, including the reverse Carnot cycle.

In closely exmaining the thermodynamic properties of the vapor compression cycle just described, the conclusion was drawn that, while conventional throttling mechanisms are in technological terms simple devices, those devices commonly employed waste energy and restrict the performance of the overall cycle because of thermodynamic irreversibility.

The solution of this problem, not shown in the prior art, would be the replacement of the conventional irreversible expansion process with an optimally reversible expansion process. Additionally, the solution would optimally include utilizing the work obtained from the reversible expansion to provide some useful work input to the system or to precompress partially the refrigerant vapor, thereby resulting in obtaining a greater amount of refrigerating capacity together with reduced net work input or compressor work. Such an improvement would not only yield more effecient performance under standard conditions, but would also extend the useful temperature range of vapor compression cycle beyond the presently realized vapor compression range.

By the way of background, during the prosecution of the prior applications indicated above numberous patents have been provided as references and other patents have otherwise been considered as of interest in preparing this application, and those which bear filing dates prior to the filing of the parent application are the following:

| Pat. No. | Inventor |
|---|---|
| 3,613,387 | S. C. Collins |
| 3,591,317 | G. D. James |
| 3,413,815 | E. G. U. Granryd |
| 3,301,471 | M. E. Clarke |
| 3,234,738 | W. L. Cook |
| 2,519,010 | E. W. Zearfoss, Jr. |
| 2,494,120 | B. J. Ferro, Jr. |
| 1,693,863 | T. I. Potter |
| 1,486,486 | P. W. Gates |
| 1,245,603 | W. Lewis |
| 801,612 | W. Schramm |
| 283,925 | J. B. Root |

The prior art devices do not provide the previously detailed efficiency advantages, nor do the patents describing such devices teach toward the present invention in which a unique, thermodynamically regenerative device provides cooling which said device simultaneously provides work output to a piston. As to matter added by way of the continuing applications, the air refrigeration device of Edwards, U.S. Pat. No. 3,686,893, has been reviewed and similarly found not to be applicable hereto.

SUMMARY OF THE INVENTION

The invention includes a gaseous fluid refrigeration process which comprises continuously supplying quantities of a gaseous fluid, expanding the compressed fluid refrigerant in an expansion chamber and concurrently compressing the same fluid stream in a compression chamber after having passed through a heat absorber, thereby producing simultaneously cooling and heating effects.

The present invention applies the compressor/expander transducer to a motor-driven, open-cycle refrigeration device which expands ambient air to a lower pressure and temperature and absorbs heat from a space (preferably, one to be cooled). The air is then compressed to a second pressure (normally, atmospheric pressure) and is released to atmosphere together with heat absorbed. This heated air is utilizable for heat pumping purposes. When applied to a vacuum refrigerator enclosure, the normally employed heat exchangers, described in the prior art, can be eliminated.

With the invention, the gaseous fluid, normally air, expands in the expansion chamber of the expander-compressor transducer, then flows through the heat absorber, and thence back into the compression chamber of the expander-compressor transducer, thereby acting upon the gaseous fluid both before and after it passes through the heat absorber, and thereafter returning to atmosphere for rejection of the heat of the heat rejecting location. When applied to conventional refrigeration, the expander-compressor transducer operates to utilize the output generated during the expansion process to precompress partially the fluid prior to its entering the suction side of the compressor. The invention reduces the network input to the conventional compressor, increases the useful operating temperature range with an improved Coefficient of Performance (C.O.P.).

In a gaseous or air cycle system, the instant invention eliminates the need for a heat rejecting heat exchanger and in some applications, such as a vacuum refrigeration process, eliminates the need for both the heat rejection and the heat absorbing heat exchanger.

DESCRIPTION OF PREFERRED EMBODIMENTS

Figure 1:
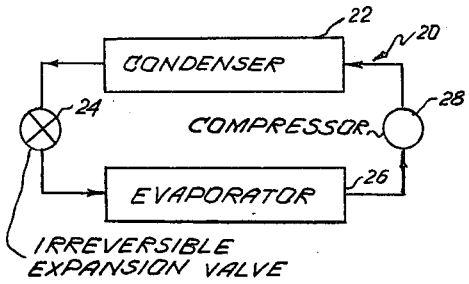
PRIOR ART FIGURE 1
FIG. 1 is a schematic diagram of a common prior art refrigeration system which is illustrated having a conventional throttling valve between the condenser and the evaporator.
Figure 2:
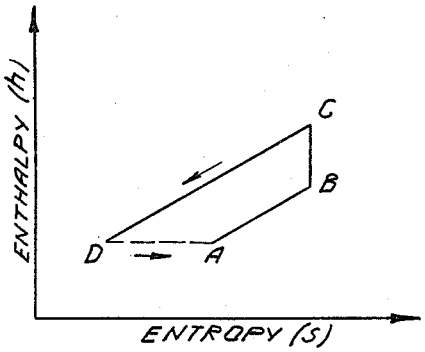
PRIOR ART FIGURE 2
FIG. 2 is an enthalpy-entropy diagram of the prior art system of FIG. 1.
Figure 3:
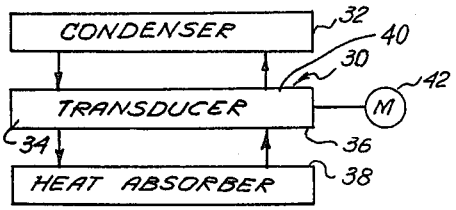
FIG. 3 is a schematic diagram of the preferred embodiment of my invention in which a refrigeration system is illustrated having a motor-operated transducer interconnecting a condenser and a heat absorber.
Figure 4:
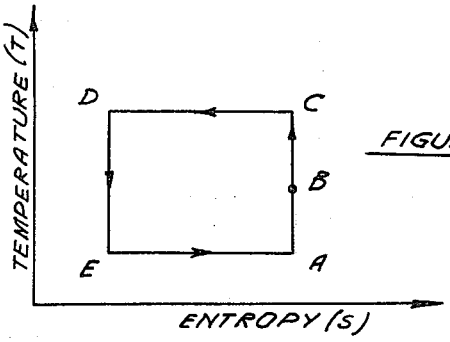
FIG. 4 is a temperature-entropy diagram for the preferred embodiment of my invention shown in FIG. 3.
Figure 5:
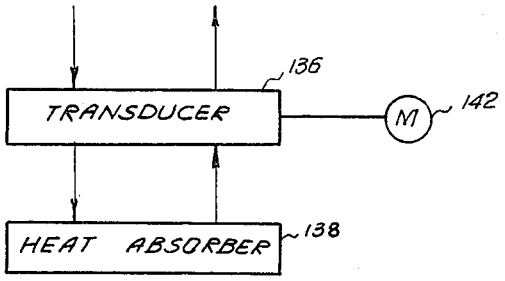
FIG. 5 is a schematic diagram of the preferred embodiment of my invention as in FIG. 3, but as air is used as the refrigerant, the condenser is not required and open-cycle operation is shown.
Figure 6:
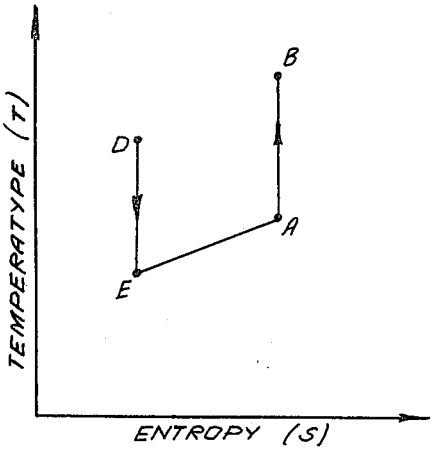
FIG. 6 is a temperature-entropy diagram for the embodiment of my invention shown in FIG. 5.

The system of the present invention is best understood in view of a present-day conventional refrigeration system. While the invention is utilizable in applications other than refrigeration cycles, the improved system is described in such a manner for expository purposes. FIG. 1 shows the schematic diagrams for the prior art refrigeration system and FIGS. 3 and 5 show schemetic diagrams for the system of the present invention. FIGS. 2, 4, and 6 show the corresponding enthalpy-entropy or temperature-entropy diagrams. In the examples discussed below, a halogenated fluorocarbon, specifically dichlorodifluoromethane, is used as the fluid refrigerant in the closed-cycle unit and air is used as the fluid refrigerant in the open-cycle unit. For a comparison of the conventional and the improved systems, the calculations assume the use of dichlordifluoromethane refrigerant in both instances with a nominal condensing saturation temperature and pressure of 120° F. and 172 psia, respectively. Also assumed are (1) no subcooling of the condensed fluid and (2) with saturated vapor leaving the evaporator, a nominal temperature and pressure of 0° F. and 24 psia, respectively. The cycles being compared further assume ideal process flow with no frictional fluid pressure losses in the conduits or heat exchangers and no mechanical frictional losses.

In the illustrated prior art ideal thermodynamic vapor system of FIGS. 1 and 2, the system referred to generally as 20, is structured to provide a saturated liquid flow. The system provides for flowing fluid to be irreversibly expanded upon passing from condenser 22 through throttling valve 24. Then to flow to a heat absorbing heat exchanger or evaporator 26 at a constant enthalpy of 36.2 BTU/lb represented by line A-D of the graph of FIG. 2. Thus in conventional systems, the throttling valve is for producing a cold, wet fluid mixture at the stated nominal evaporator temperature and pressure. The system then provides for the wet mixture flow through the evaporator 26 exiting as a saturated vapor having an enthalpy of 78.2 BTU/lb at point C of the graph. The resultant useful refrigeration is 42 BTU/lb. The system provides for the saturated vapor to be compressed by a compressor 28. The compression is ideally isentropic along line B-C of the graph to 172 psia with an enthalpy of 94 BTU/lb. The resultant work required by a compressor 28 is 15.8 BTU/lb. Thus, the structure provides for a coefficient of performance COP of 42/15.8 or 2.7. Upon compression the fluid is then returned to condenser 22, the effect of which is represented by line C-D of the graph of FIG. 2.

In the thermodynamic cycle of the present invention, referred to generally as 30, FIG. 3, starting with the same condensed fluid state as in the previous illustrations. The system of the invention is structured to provide a flow from condenser 32 of saturated liquid dichlorodifluoromethane at 172 psia and 120° F. The fluid has enthalpy of 36.2 BTU/lb, and is ideally isentropically expanded along line D-E of FIG. 4, in a first expansion chamber portion 34, FIG. 3, of transducer 36 to the heat absorber pressure of 24 psia with an enthalpy of 32.2 BTU/lb. This wet mixture then passes through an isothermal phase through the heat absorbing heat exchanger or evaporator 38, represented by E-A of FIG. 4, exiting as a saturated vapor as in the prior art example and having an enthalpy of 78.2 BTU/lb.

This saturated vapor then enters a second compression chamber portion 40, FIG. 3, of transducer 36 using the prior work output of the expanding fluid in the expansion chamber portion 34 to aid in increasing the pressure thereof and after passing through another isentropic phase exits at 82.2 BTU/lb at point C of FIG. 4. The transducer is operated by electric motor drive 42 which in the embodiments shown drives the piston (see description below) in a reciprocal manner and approaches an efficient reverse Carnot cycle device.

The system then provides for the refrigerant to be compressed isentropically along line A-C in a compression chamber portion 40, FIG. 3, exiting at the same thermodynamic state, represented by point C, FIG. 4, as the conventional cycle and having an enthalpy of 94 BTU/lb. Upon compression the fluid is then returned to condenser 32, FIG. 3, line B-A-E of FIG. 4. The refrigeration obtained in the evaporator is 46 BTU/lb and the work required in the compressor is 11.8 BTU/lb. The resultant C.O.P. is equal to 46/11.8 or 3.9. The C.O.P. is thus improved over conventional refrigeration vapor cycles by 45%

Figure 9:
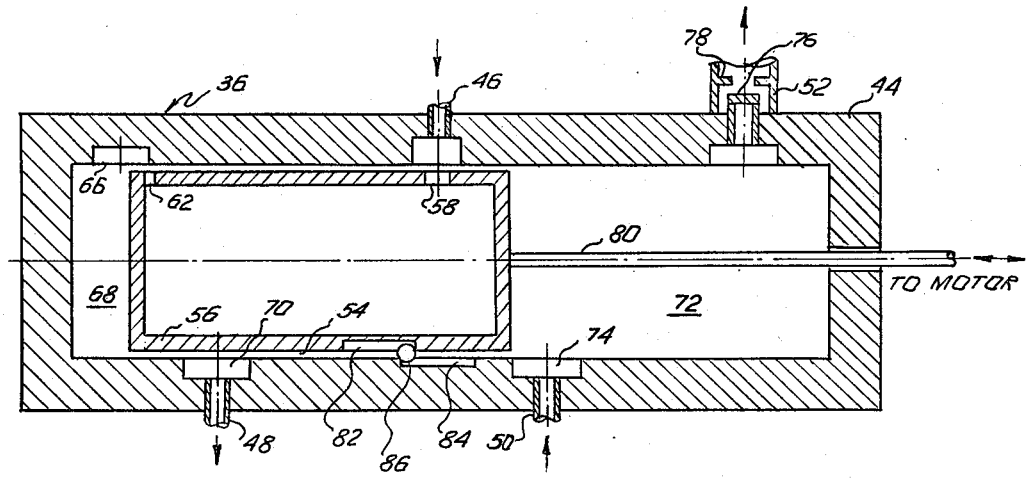
FIG. 9 is a schematic, cross-sectional view of the transducer of the preferred embodiment of FIGS. 3 and 5; and, FIG. 10 is a schematic diagram of another embodiment of my invention which shows the embodiment of FIGS. 3 and 5 in a split piston arrangement.

Referring now to FIG. 9 showing the preferred form of the embodiment of the motor-driven compressor-expander apparatus (M-CEXA) or transducer 36. The transducer comprises the outer shell or structural housing 44 which is provided with connections for heat absorber, compressor, and condenser as described schematically in FIG. 3. High pressure inlet conduit 46 is structured for directing the fluid to the M-CEXA from condenser 32; expansion fluid outlet conduit 48, for directing the fluid to the heat absorber 38; and low pressure inlet conduit 50, for receiving the fluid from the heat absorber 38; and fluid inlet conduit 52, for returning the fluid to the inlet side of the condenser.

Within the structural housing 44 is a fluid chamber 54 and a piston 56 which oscillates by action of two communicating fluids therein. Piston 56 is a closed container with piston fluid inlet passage 58 located on the wall thereof in a manner so as to permit high pressure fluid from condenser 32 access to passage 58 when aligned with high pressure inlet port 60 on the wall of the action chamber 54 through the high pressure inlet conduit 46.

The structure provides for the fluid path to continue through piston fluid outlet passage 62 in the wall of the piston 56 then to pass through the passage chamber 66 to compress momentarily in the expansion chamber 68. Piston fluid outlet passage 62 is located on piston 56 so that alignment with the expansion chamber outlet port 70 will not occur. To maintain a fluid tight connection during oscillation and to prevent leakage, clearance tolerances between piston 56 and fluid action chamber 54 are very close.

Also within structural housing 44 and forming another portion of fluid action chamber 54 is the compression chamber 72 which is provided for the correspondingly opposite action of expansion chamber 68. The structure provides for fluid acted upon in a compression chamber 72 to be directed thereinto by conduit 50 through low pressure inlet port 74 and to be directed therefrom, after passing through fluid outlet check valve 76 by conduit 52. The check valve 76 is retained between the exterior wall of housing 44 and conduit 52 by retainer 78. The piston 56 is provided with a powered return through shaft 80 (connected to motor drive 42) which, upon sufficient fluid flowing through passage 66 and into expansion chamber 68 and upon consequent movement of piston 56 decreasing the size of compression chamber 72, is provided to restore piston 56 to its original position in an oscillatory manner. Although shown as an electric motor drive in this embodiment, the return means may be any of a number of motive devices known in the art.

Alignment means of the piston 56 is provided by the action of piston alignment groove 82 and housing alignment groove 84 and alignment ball-bearing 86. The motor drive is synchronized to automatically locate piston 56 in the starting position.

In cyclic operation, piston 56 moves within fluid action chamber 54 in an oscillating action. As the piston 56 moves to the right as shown in the diagram and outlet piston passage 62 is shut by the wall of the fluid action chamber 54 and the piston inlet passage 58 is similarly closed. The pressure and temperature of the refrigerant contained in the expansion chamber 68 reducing its temperature and pressure until the expansion chamber outlet port 70 is uncovered by piston 56 allowing refrigerant to flow through expansion chamber outlet conduit 48 to the heat absorber 38. The motion of the piston 56 is controlled by the combined action of the motor drive 42 and the action of the compressed fluid in the compressed chamber 72. After the motion to the right is terminated, the piston 56 is returned to its original position on the left portion of the fluid action chamber 54 by the action of the motor drive 42 and the compression in the compression chamber 72.

Again, as the piston 56 moves to the right, the low pressure inlet port 74 in the compression chamber 72 is covered and the vapor pressure therein increases and causes the compressed vapor outlet check valve 76 to open, allowing the compressed fluid to flow through the compressed fluid outlet conduit 52. The check valve 76 is controlled by the compressed vapor outlet check valve retainer 78.

In cyclic operation, as piston 56 moves from the right hand position to the left, the compressed fluid outlet check valve 76 closes and the pressure of the fluid in compression chamber 72 reduces. As piston 56 continues its movement to the left, low pressure fluid flows into compression chamber 72 through low pressure inlet conduit 50 and through low pressure inlet port 74.

As piston 56 moves from right to left further, high pressure fluid again flows from the exterior source into piston 56 through inlet passage 58 to maintain the high pressure in the interior of piston 56. The continued motion of the piston 56 to the left into the expansion chamber 68 causes the fluid therein to be compressed. At the left position of the piston 56 in the expansion chamber 68, high pressure fluid is partially released when piston outlet passage 62 communicates with passage chamber 66 allowing a portion of the compressed fluid to flow into the expansion chamber 68, whereby piston 56 eventually stops and reverses its direction of motion towards the compression chamber 72.

The transducing action of the expander-compressor transducer occurs upon the energy stored in the high pressure refrigerant liquid being transferred into useable compression work. Using the work from both ends of the oscillatory piston movement is a characteristic feature of the transducing energy relationship of this invention.

The motor expander-compressor transducer cycle operates through the introduction of a high pressure fluid from the condenser source, through passage 58 of the piston 56 to a varying volume in the fluid action chamber 54, a high pressure in the expansion chamber 68, and a compression chamber 72, respectively. The fluid expands in the expansion chamber 68, driving the piston 56, permitting the fluid to flow from expansion chamber 68 through the heat absorber 38 to a low pressure region in compression chamber 72. The fluid absorbes heat in the process. The fluid is further compressed in compression chamber 72, raising the pressure slightly above the level of the inlet pressure of of the condenser in the case of a closed vapor refrigeration sytem. The motor-operated expander-compressor transducer is adjusted to result in oscillatory motion that produces expansion work and assits to aid the motor in its compression work. It will, of course, be understood that the fluid exiting from the compression chamber 72 will return to the inlet side of the condenser.

Figure 7:
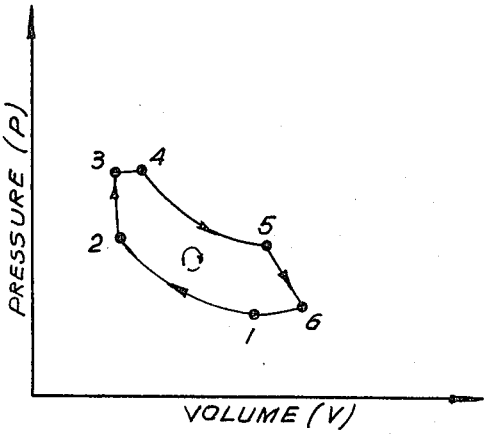
FIG. 7 is a graphical representation of the pressure-volume operational aspect of the expansion chamber of the transducer of the preferred embodiment shown in FIGS. 3 and 5.

The pressure-volume relationship for the expander occurring in the expansion chamber portion 34 of FIG. 3 is shown in FIG. 7. Starting at the state point 4 expanding the refrigerant fluid to state point 5 where the expansion chamber outlet conduit 70 of FIG. 9 is uncovered and the pressure drops down to the heat absorber pressure at point 6. This point also represents the piston travel limit. The piston 56 then reverses direction as urged by the rec iprocating motor 42. The evaporator operates isobarically from state point 6 to state point 1 where the expansion chamber outlet conduit 70 is covered and the pressure increases until outlet piston passage 62 and passage chamber 66 communicate allowing the high pressure fluid contained within the piston 56 to flow into expansion chamber 68 thereby increasing the pressure from state point 2 to state point 3 at which point the outlet piston passage 62 is closed by the left edge of the piston head plate 64. The pressure is shown relatively constant immediately from point 3 to point 4 after reversing the piston until outlet piston passage 62 is no longer communicating with passage chamber 66. The actual cycle configuration will vary somewhat with the design and speed parameters. The closed cycle 1-2-3-4-5-6-1 is a new and novel refrigeration cycle which uniquely combines characteristics of both the reversed Otto and Brayton thermodynamic engine cycles.

Figure 8:
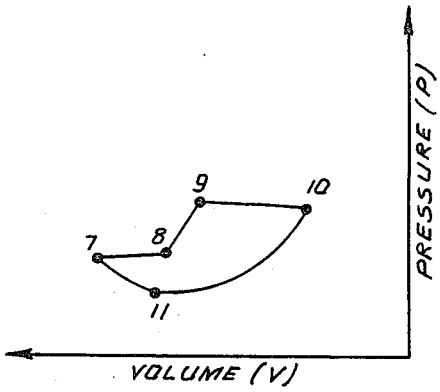
FIG. 8 is a graphical representation of the pressure-volume operational aspect of the compression chamber of the transducer of the preferred embodiment shown in FIGS. 3 and 5.

The pressure-volume relationship occuring in the compression chamber portion 40 of FIG. 3 is detailed in FIG. 8. Starting at state point 7, with piston 56 of FIG. 9 at the extreme left side of the expander-compressor transducer, the evaporator pressure nominally exists from state point 7 to state point 8 at which point the low pressure inlet port 74 is covered. The vapor pressure is increased by the combined action of the expansion chamber 68 and the motor drive device until its pressure is nominally equal to the pressure at the inlet to the condenser. The pressure remains constant from state point 9 to state point 10 until the opening to outlet check valve 76 is covered by the leading edge of the piston. The motor drive means and inertial effects causes the piston 56 to reverse and results in an ideally isentropic expansion to a pressure lower than the evaporator pressure at state point 11 where the low pressure inlet port 74 is uncovered by the right hand edge of the piston 56. The refrigerant vapor from the evaporator flows into the compression chamber 72 increasing the pressure therein up to the evaporator pressure at state point 7. The cycle 7-8-9-10-11-7 is repeated.

The energy output of the expansion chamber 68 cycle 1-2-3-4-5-6-1 plus the motor drive device energy input is equal to the energy input of the compression chamber 72 cycle 7-8-9-10-11-7 plus the losses. The representations shown in FIGS. 7 and 8 consist of quasi-idealized processes.

Figure 10:
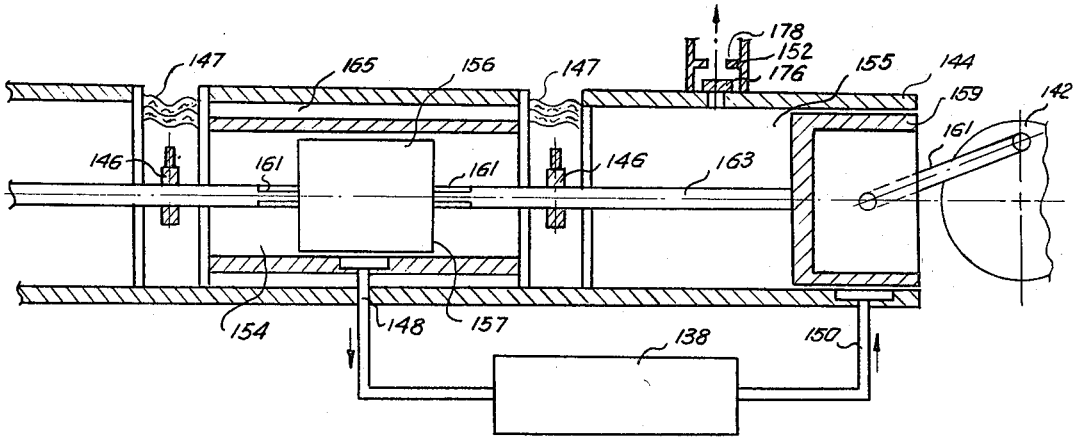

Referring now to FIGS. 5, 6 and 10, the embodiment shown is referred to generally as an open-cycle, split-piston arrangement of the motor-driven, compressor-expander apparatus (M-CEXA) or transducder 136. The transducer 136 has an outer shell or structural housing 144 which is provided with air inlet conduits 146 and air filters 147 for provided filterd ambient air to the M-CEXA. The air outlet conduit 148 is structured for transmitting air to the heat absorber 138; low pressure inlet conduit 150, for receiving the returning air from the heat absorber; and low pressure outlet conduit 152 for returning air to ambient.

Within housing 144 are fluid chambers 154 and 155 and a split-piston assembly 156. The rearward portion 157 of split-piston 156 is double-acting and operates within chamber 154, and the forward portion 159 of split-piston 156 is single-acting and operates within chamber 155. The motor drive 142 oscillates the split-piston assembly 156 through crank arrangement 161 and shaft 163. One shaft 163 adjacent forward portion 159 are air inlet passageways 161 which, when the piston 157 is at either end of chamber 154, communicates with air inlet 146. During oscillation piston 157 is structured to cover and uncover air outlet conduit 148 so as to permit expanded fluid to be drawn into the heat absorber 138. The walls of expansion chamber 154 are provided with insulation 165. Upon oscillation of piston 159, air exhausted by heat absorber 138 into the compression chamber 155 is compressed and overcomes check valve 176 and 178 (analogous to check valve 76 and 78 discussed hereinbefore) and is exhausted to atmosphere. During oscillation, piston 159 is structured to cover and uncover air inlet conduit 150 so as to permit air cooled by the heat absorber 138 to enter compression chamber 155.

While the specific embodiments of my invention has been shown and described in detail to illustrate the invention, it will be understood that the invention may be embodied otherwise, that certain changes are possible without departing from the scope of the invention; and it is intended that all matter contained in the above description herein shall be interpreted as illustrative and not in a limited sense.

What is claimed is:

1. An improved expander-compressor transducer for expanding refrigerant fluid from a high pressure source into a low pressure heat absorbing heat exchanger while simultaneously compressing the same fluid stream derived from the low pressure heat absorbing heat exchanger, said expander-compressor transducer having:

a body member enclosing a chamber for confinement of a refrigerant;

fluid responsive piston means arranged to oscillate in said chamber and dividing said chamber into an expansion chamber at one end and a compression chamber at the other end;

fluid control regulating means for permitting flow of refrigerant fluid into and out of said expansion chamber and into said compression chamber; and, check valve means for permitting refrigerant flow out of said compression chamber whenever the pressure in said compression chamber is higher than the fluid pressure immediately downstream of said check valve means;

wherein said improvement is characterized by:

motive means for oscillating said piston means within said chamber and causing said gaseous fluid to expand in said expansion chamber and concurrently to compress in said compression chamber;

thereby producing simultaneously cooling and heating effects.

2. An improved expander-compressor transducer as described in claim 1 wherein said refrigerant fluid is air and upon compression, is exhausted to atmosphere through said check valve means whenever the compression chamber pressure is greater than ambient pressure.

3. An improved expander-compressor transducer as described in claim 2 wherein said expansion chamber is compartmented to receive a double-acting piston, thereby expanding air, which is drawn into a first end thereof while drawing air into a second end thereof, and then conversely drawing air into said first end thereof while expanding air, which is present in said second end thereof.

4. An improvided expander-compressor transducer as described in claim 3 wherein said piston means in turn comprises a first fluid passageway and corresponding first port thereto, said port being in communication with first fluid passageway at the lower travel limit of said piston means and a second fluid passageway and corresponding second port thereto, said port being in communication with said second fluid passageway at the upper travel limit of said piston means.

5. An improved expander-compressor transducer as described in claim 1 wherein said fluid control regulating means is connected to the outlet of a heat rejecting heat exchanger and said check valve means is connected to the inlet of a heat rejecting heat exchanger.

6. An improved expander-compressor transducer as described in claim 5 wherein said expansion chamber is compartmented to receive a double-acting piston, thereby expanding refrigerant which is drawn into a first end thereof while drawing refrigerant into a second end thereof, and then conversely drawing refrigerant into said first end thereof, while expanding refrigerant which is present in said second end thereof.

7. An improved expander-compressor transducer as described in claim 10 wherein said piston means in turn comprises a first fluid passageway and corresponding first port thereto, said port being in communication with first fluid passageway at the lower travel limit of said piston means and a second fluid passageway and corresponding second port thereto, said port being in communication with said second fluid passageway at the upper travel limit of said piston means.

* * * * *